US008284116B2

(12) United States Patent
Hwang et al.

(10) Patent No.: US 8,284,116 B2
(45) Date of Patent: Oct. 9, 2012

(54) ANTENNA APPARATUS FOR INTERNAL IMPEDANCE MATCHING

(75) Inventors: Soon Ho Hwang, Seoul (KR); Joon Ho Byun, Yongin-si (KR); Tae Sik Yang, Suwon-si (KR); Sung Koo Park, Suwon-si (KR); Austin Kim, Seongnam-si (KR); Kyung Kyun Kang, Suwon-si (KR)

(73) Assignee: Samsung Electronics Co., Ltd (KR)

( * ) Notice: Subject to any disclaimer, the term of this patent is extended or adjusted under 35 U.S.C. 154(b) by 370 days.

(21) Appl. No.: 12/647,128

(22) Filed: Dec. 24, 2009

(65) Prior Publication Data

US 2010/0156748 A1 Jun. 24, 2010

(30) Foreign Application Priority Data

Dec. 24, 2008 (KR) ..... 10-2008-0132997

(51) Int. Cl.
*H01Q 1/50* (2006.01)

(52) U.S. Cl. ..... 343/860; 343/700 MS

(58) Field of Classification Search ..... 343/700 MS, 343/702, 850, 860
See application file for complete search history.

(56) References Cited

U.S. PATENT DOCUMENTS 4,079,268 A * 3/1978 Fletcher et al. ..... 307/151
7,505,001 B2 * 3/2009 Deavours et al. ..... 343/700 MS
8,094,076 B2 * 1/2012 Zhang et al. ..... 343/700 MS

* cited by examiner

*Primary Examiner* — Tan Ho
(74) *Attorney, Agent, or Firm* — The Farrell Law Firm, P.C.

(57) ABSTRACT

An antenna apparatus allows for internal impedance matching by employing an internal matching device therein. The antenna apparatus includes a board body formed of a dielectric material and having a flat structure. The antenna apparatus also includes an antenna device disposed on an upper surface of the board body, and the internal matching device disposed on a lower surface of the board body. The antenna device extends from a feed point and has a first impedance. The internal matching device is connected to the antenna device and has a second impedance used for matching the first impedance with a reference impedance. The antenna device and the internal matching device resonate at the reference impedance in a specific frequency band when a voltage is supplied through the feed point.

14 Claims, 12 Drawing Sheets

(a)

(b)

(a)

(b)

ANTENNA APPARATUS FOR INTERNAL IMPEDANCE MATCHING

PRIORITY

This application claims priority under 35 U.S.C. §119(a) to an application entitled "ANTENNA APPARATUS FOR INTERNAL IMPEDANCE MATCHING" filed in the Korean Intellectual Property Office on Dec. 24, 2008 and assigned Serial No. 10-2008-0132997, the content of which is incorporated herein by reference.

BACKGROUND OF THE INVENTION

1. Field of the Invention

The present invention relates generally to an antenna for a wireless communication terminal and, more particularly, to an antenna apparatus allowing for internal impedance matching.

2. Description of the Related Art

Wireless communication systems generally provide a variety of multimedia services, which include Global Positioning System (GPS) based services, Bluetooth based services, Internet related services, etc. In order to favorably realize such services, a high data transmission rate is required for a large volume of multimedia data. One way this requirement can be met is by improving the performance of antennas in communication terminals.

Additionally, there is increasing tendency to make communication terminals smaller, thinner, lighter, and more multifunctional, in accordance with market demands for improving mobility and portability of the terminals. Traditional projecting or extractable antennas are often unfavorable for portability and very susceptible to external shock or impact. Therefore, most recently developed antennas are embedded in the terminals. Specifically, the antennas are fabricated in the form of an intenna.

However, it is difficult to realize a size-reduced antenna apparatus having a reference impedance for resonance in a specific frequency band. Thus, a conventional antenna apparatus in a communication terminal may be coupled to an external matching circuit so as to secure a reference impedance. The use of the external matching circuit may, however, be unfavorable for miniaturization of communication terminals and may cause a return loss during resonance.

BRIEF SUMMARY OF THE INVENTION

The present invention has been made to address the above problems and/or disadvantages and to provide at least the advantages described below. Accordingly, an aspect of the present invention provides an antenna apparatus that allows for internal impedance matching.

According to one aspect of the present invention, an antenna apparatus is provided for internal impedance matching. The antenna apparatus includes a board body formed of a dielectric material and having a flat structure. The apparatus also includes an antenna device disposed on an upper surface of the board body, extending from a feed point, and having a first impedance. The apparatus further includes an internal matching device disposed on a lower surface of the board body, connected to the antenna device, and having a second impedance used for matching the first impedance with a reference impedance. The antenna device and the internal matching device resonate at the reference impedance in a specific frequency band when a voltage is supplied through the feed point.

According to another aspect of the present invention, an antenna apparatus is provided for internal impedance matching. The antenna apparatus includes a board body formed of a dielectric material and having a flat structure. The apparatus also includes an antenna device disposed on an upper surface of the board body, extending from a feed point, and having a first impedance. The apparatus further includes an internal matching device disposed on the upper surface of the board body, connected to the antenna device, and having a second impedance used for matching the first impedance with a reference impedance. The antenna device and the internal matching device resonate at the reference impedance in a specific frequency band when a voltage is supplied through the feed point.

BRIEF DESCRIPTION OF THE DRAWINGS

The above and other aspects, features and advantages of the present invention will be more apparent from the following detailed description when taken in conjunction with the accompanying drawings, in which.

DETAILED DESCRIPTION OF EMBODIMENTS OF THE PRESENT INVENTION

Figure 1:
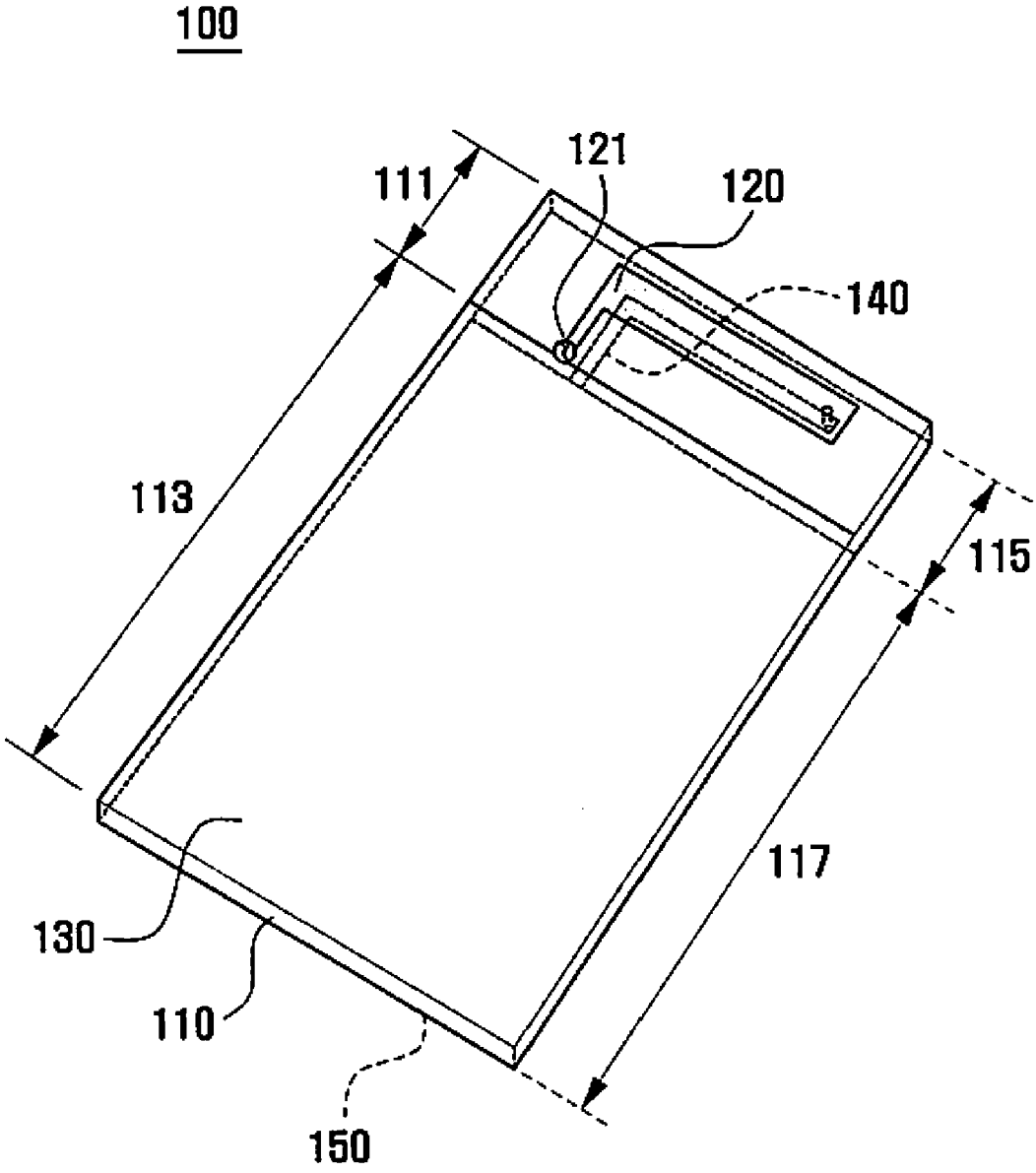
FIG. 1 is a diagram illustrating a perspective view of a front side of an antenna apparatus, according to an embodiment of the present invention.

Embodiments of the present invention are described in detail with reference to the accompanying drawings. The same or similar components may be designated by the same or similar reference numerals although they are illustrated in different drawings. Detailed descriptions of constructions or processes known in the art may be omitted to avoid obscuring the subject matter of the present invention.

Figure 2:
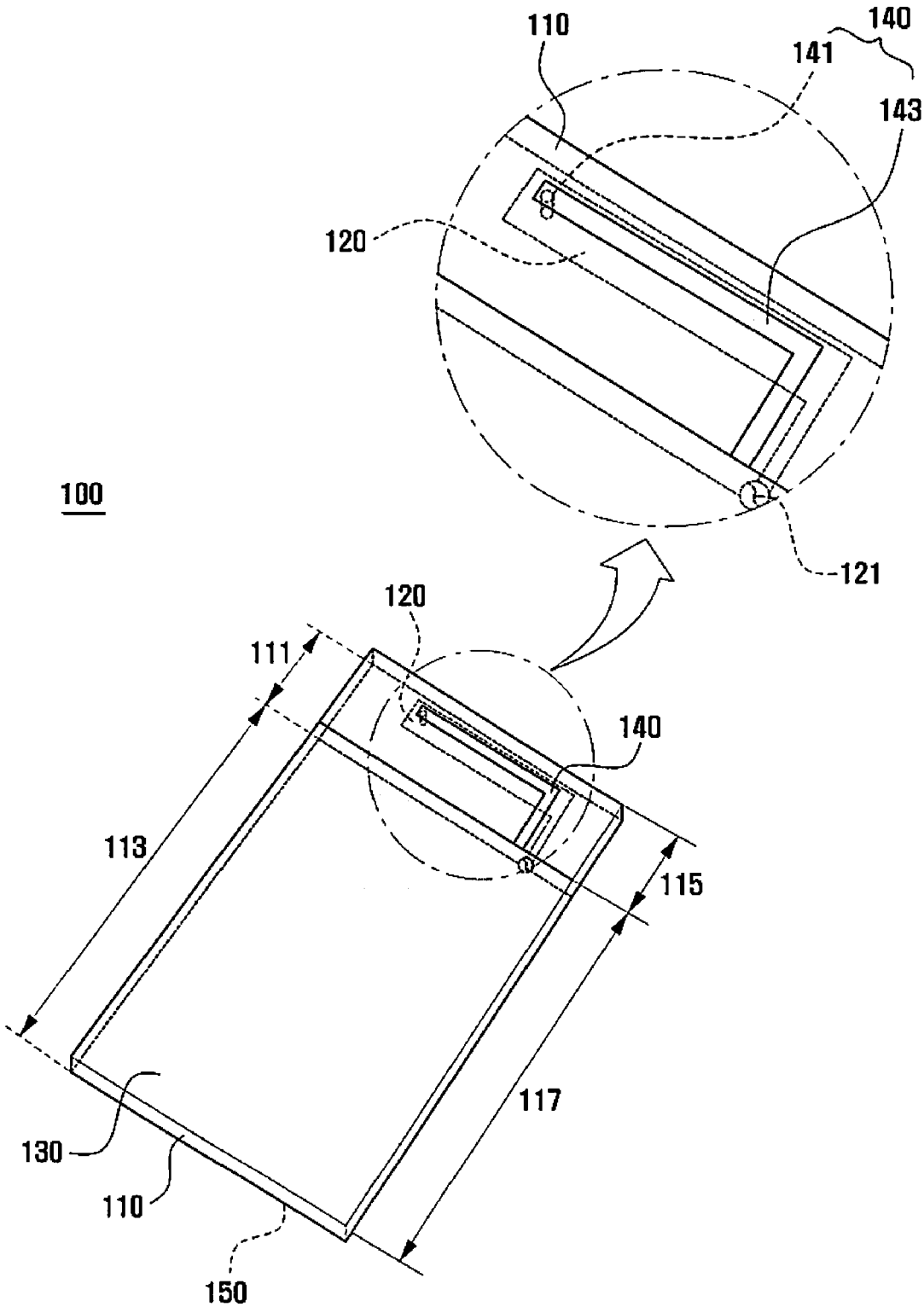
FIG. 2 is a diagram illustrating a perspective view of a rear side of an antenna apparatus, according to an embodiment of the present invention.

Referring initially to FIG. 1, a diagram illustrates a perspective view of a front side of an antenna apparatus 100, according to a first embodiment of the present invention. FIG. 2 is a diagram illustrating a perspective view of a rear side of the antenna apparatus 100, according to the first embodiment of the present invention. In this embodiment of the present invention, the antenna apparatus 100 is fabricated in accordance with Printed Circuit Board (PCB) technology.

The antenna apparatus 100, also referred to as an Internal Matching Antenna (IMA) apparatus, includes a board body 110, an antenna device 120, a board ground layer 130, an internal matching device 140, and a matching ground layer 150.

The board body 110 is a supporting base of the antenna apparatus 100. Generally, the board body 110 has a flat structure with at least four corners and the majority of it is formed of a dielectric material. An upper surface of the board body 110 is divided into an upper device region 111 and an upper ground region 113. The upper device region 111 may occupy at least two corners of the board body 110. In addition, a lower surface of the board body 110 is divided into a lower device region 115 and a lower ground region 117. Here, the lower device region 115 and the lower ground region 117 may coincide with the upper device region 111 and the upper ground region 113, respectively.

The antenna device 120 is configured to transmit and receive signals in a predetermined frequency band. Specifically, the antenna device 120 resonates in a specific frequency band and thereby passes signals. The antenna device 120 is configured to have a first impedance and resonates at a given reference impedance.

In addition, the antenna device 120 is formed in the upper device region 111 of the board body 110 through a pattern of metal on the surface of the upper device region 111. More particularly, the antenna device 120 has a feed point 121 at one end disposed near the board ground layer 130. The feed point 121 may penetrate through the board body 110 and communicate with the lower surface of the board body 110. The antenna device 120 is extended in a particular form from the feed point 121 on the surface of the upper device region 111. A voltage is supplied to the antenna device 120 through the feed point 121.

The antenna device 120 may be composed of at least one parallel component circuit and at least one perpendicular component circuit, which are connected to and distinguished from each other by at least one bent portion. The feed point 121 is formed at one end of the perpendicular component circuit of the antenna device 120. For example, the antenna device 120 may be formed as a particular type of transmission line, such as a meander type, a spiral type, a step type, a loop type, and so forth. Also, the antenna device 120 may be embodied in the form of an Inverted L Antenna (ILA).

The board ground layer 130 is configured for grounding of the antenna device 120. The board ground layer 130 is formed in and covers the upper ground region 113 of the board body 110.

The internal matching device 140 is configured to match the first impedance of the antenna device 120 with the reference impedance. Therefore, the internal matching device 140 has a second impedance to match the first impedance with the reference impedance. The internal matching device 140, together with the antenna device 120, can resonate at the reference impedance. Specifically, the internal matching device 140 as well as the antenna device 120 may resonate in a specific frequency band and thereby pass signals. The internal matching device 140 is extended from the antenna device 120 and formed in the lower device region 115 of the board body 110. The internal matching device 140 is formed through a pattern of metal, in a manner similar to the antenna device 120. The internal matching device 140 has a matching via 141 and a matching line 143.

The matching via 141 is configured to penetrate the board body 110 from the antenna device 120. Specifically, the matching via 141 is formed as a hole that is filled with conductive material. Therefore, the internal matching device 140 is physically and electrically connected to the antenna device 120 through the matching via 141. The matching via 141 may be connected to one end of the parallel component circuit of the antenna device 120. Alternative embodiments may include more than one matching via 141.

The matching line 143 extends from the matching via 141 and forms a single path on the lower surface of the board body 110. The matching line 143 is located in the lower device region 115 and also formed through a pattern of metal. The matching line 143 may be composed of a first matching line and a second matching line, which are connected to and distinguished from each other by at least one bent portion. The first matching line is extended in a direction that is parallel with the matching ground layer 150, and the second matching line is extended in a direction that is perpendicular to the matching ground layer 150. Additionally, the first matching line may overlap the parallel component circuit of the antenna device 120. For example, the matching line 143 may be formed as a particular type of transmission line, such as a meander type, a spiral type, a step type, a loop type, and so forth. Also, the matching line 143 may be embodied in the corresponding form of ILA.

The matching ground layer 150 is configured for grounding the internal matching device 140. Here, the matching ground layer 150 is connected to the matching line 143, specifically at one end of the second matching line. The matching ground layer 150 is formed in and covers the lower ground region 117 of the board body 110.

Figure 3:
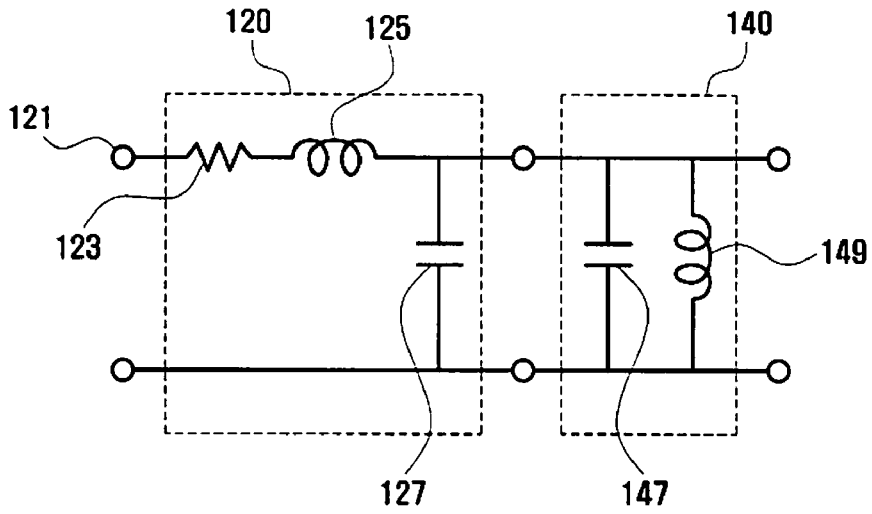
FIG. 3 is a circuit diagram illustrating an equivalent circuit of an antenna apparatus, according to an embodiment of the present invention.

In the antenna apparatus 100, the antenna device and the internal matching device 140 are designed to have specific electrical properties, which is described in greater detail with respect to FIG. 3. FIG. 3 is a circuit diagram illustrating an equivalent circuit of the antenna apparatus 100, according to the first embodiment of the present invention. Although this embodiment employs the antenna device 120 and the internal matching device 140 respectively formed in a single cell, the present invention is not limited thereto. Alternatively, the antenna device 120 and the internal matching device 140 may be respectively formed in a plurality of cells.

In the antenna apparatus 100, the antenna device 120 and the internal matching device 140 are interconnected.

The antenna device 120 is configured to have an effective radiation resistance, an effective inductance, and an effective capacitance for allowing resonance in a specific frequency band, and therefore has the first impedance. Specifically, the antenna device 120 is composed of a resistor 123, a first inductor 125, and a first capacitor 127. The resistor 123 and the first inductor 125 are connected in series, whereas the first inductor 125 and the first capacitor 127 are connected in parallel.

The electrical properties of the antenna device 120 depend upon materials and physical dimensions. For example, the effective radiation resistance of the antenna device 120 may depend on the material (e.g., metal) used in forming the antenna device 120. The effective inductance of the antenna device 120 may depend on a total length and width of the antenna device 120. The effective capacitance of the antenna device 120 may depend on a length of the perpendicular component circuit of the antenna device 120 and a distance between the parallel component circuit and the board ground layer 130.

The internal matching device 140 is configured to have a matching capacitance and a matching inductance for matching the first impedance with the reference impedance, and therefore has the second impedance. Specifically, the internal matching device 140 is composed of a second capacitor 147 and a second inductor 149. The second capacitor 147 and the second inductor 149 are connected in parallel.

The electrical properties of the internal matching device 140 depend upon physical dimensions. For example, the matching capacitance of the internal matching device 140 may depend on an overlapped length and width of the internal matching device 140 with the antenna device 120. The matching inductance of the internal matching device 140 may depend on a total length and width of the internal matching device 140.

Figure 4:
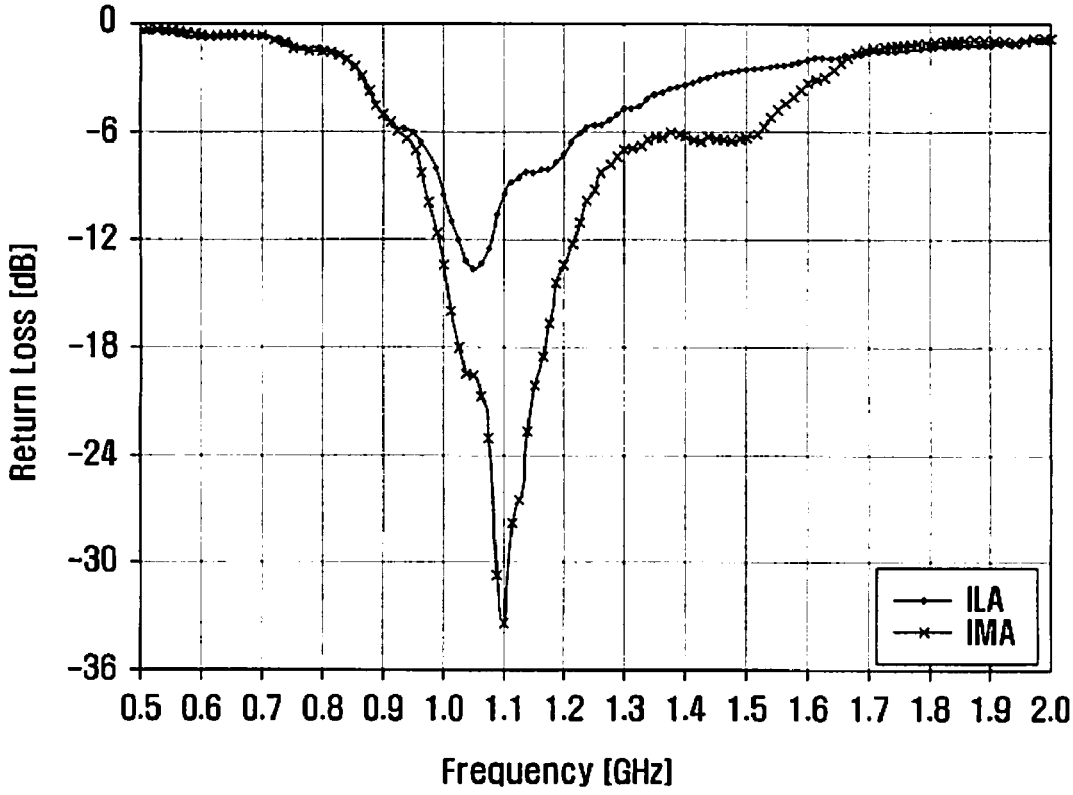
FIG. 4 is a graph illustrating impedance matching characteristics of an antenna apparatus, according to an embodiment of the present invention.
Figure 5:
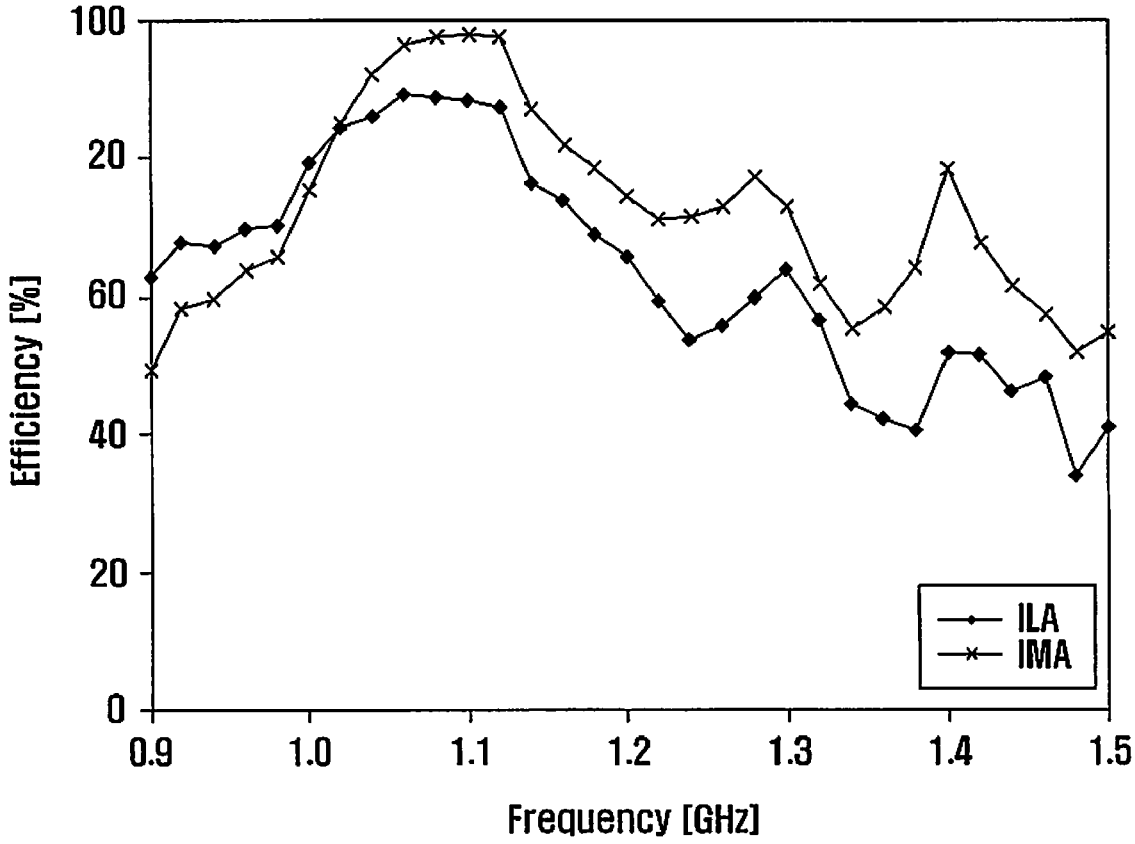
FIG. 5 is a graph illustrating operation efficiency characteristics of an antenna apparatus, according to an embodiment of the present invention.

The antenna apparatus 100 with the above configuration has improved characteristics, which are described in greater detail with respect to FIGS. 4 and 5. FIG. 4 is a graph illustrating impedance matching characteristics of the antenna apparatus 100, according to the first embodiment of the present invention. FIG. 5 is a graph illustrating operation efficiency characteristics of the antenna apparatus 100, according to the first embodiment of the present invention. The antenna apparatus 100 having the internal matching device 140 is represented as IMA, and a conventional antenna apparatus having an external matching circuit is represented as ILA. Experiments were carried out using antenna apparatuses of the same size.

Referring to FIG. 4, a difference in impedance matching characteristics between the antenna apparatus 100 and a conventional antenna apparatus was examined by comparing their frequency bandwidths. A Voltage Standing Wave Ratio (VSWR), which indicates a degree of impedance matching, of the frequency bandwidths ranges from 1 to 2. The antenna apparatus 100 shows a return loss under −6 dB in frequencies from about 930 MHz to about 1510 MHz, which is approximately a 580 MHz bandwidth. A conventional antenna apparatus shows a return loss under −6 dB in frequencies from about 950 MHz to about 1210 MHz, which is approximately a 260 MHz bandwidth.

Therefore, when compared with a conventional antenna apparatus, the antenna apparatus 100 allows for impedance matching in wider frequency bandwidth of more than twice that of the conventional apparatus. Specifically, the antenna apparatus 100 can resonate in wider frequency bandwidth when compared with a conventional antenna apparatus.

Referring to FIG. 5, a difference in operation efficiency characteristics between the antenna apparatus 100 and a conventional antenna apparatus was examined in the resonant frequencies from about 900 MHz to about 1500 MHz. As shown, the antenna apparatus 100 has an operation efficiency that is better than that of a conventional antenna apparatus by about 10% or more.

According to this embodiment of the present invention, the antenna apparatus 100 allows for internal impedance matching by employing the internal matching device 140. The internal matching device 140 can improve impedance matching characteristics of the antenna apparatus 100. Furthermore, resonance in a specific frequency band of both the internal matching device 140 and the antenna device 120 can improve operation efficiency characteristics of the antenna apparatus 100.

Although the internal matching device of the aforesaid embodiment has only a single elongated path, the present invention is not limited thereto. Alternatively, the internal matching device may have two or more elongated paths.

For example, the internal matching device may further include a branch line in addition to the above-described matching line.

Figure 6:
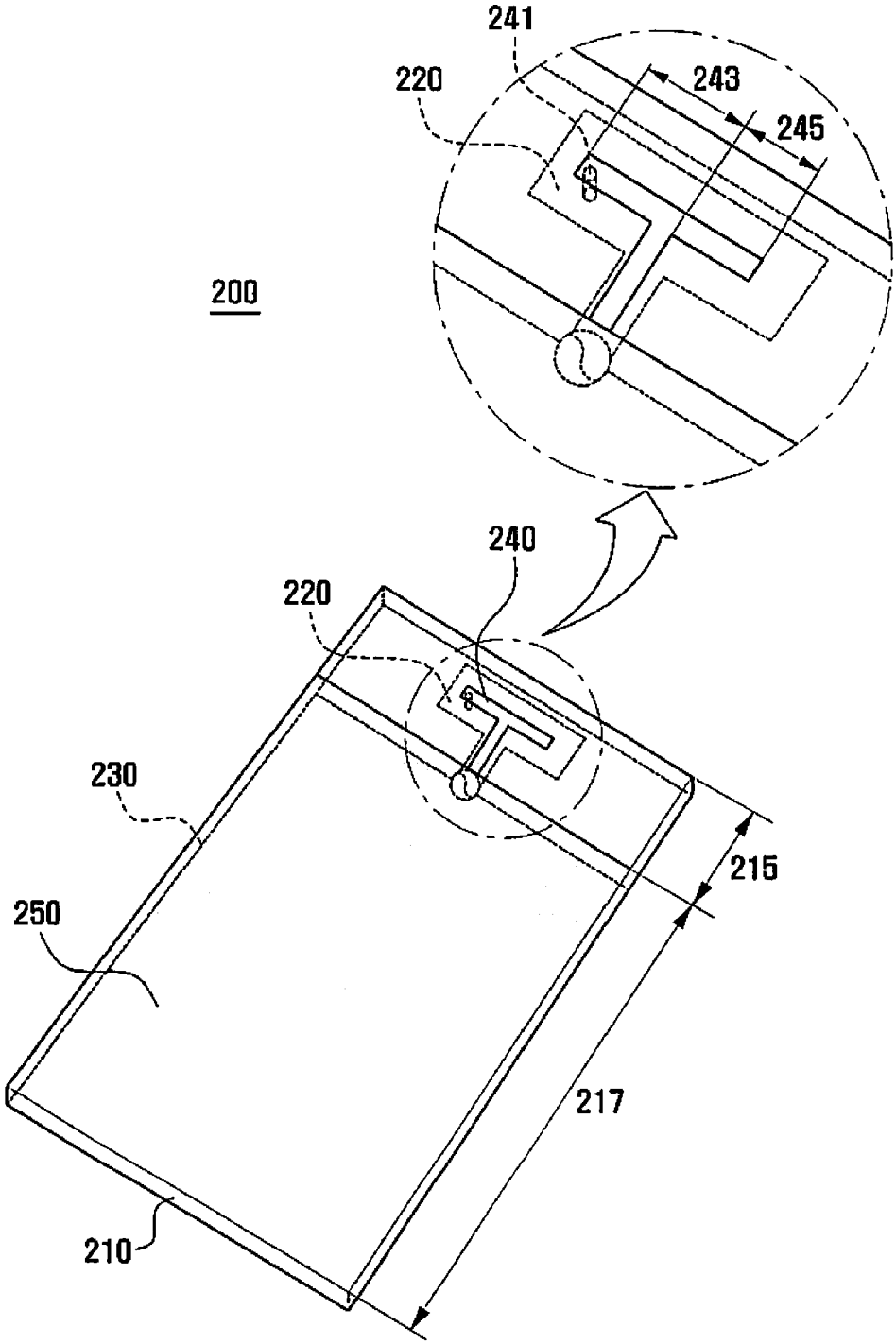
FIG. 6 is a diagram illustrating a perspective view of a rear side of an antenna apparatus, according to a second embodiment of the present invention.

FIG. 6 is a diagram illustrating a perspective view of a rear side of an antenna apparatus, according to a second embodiment of the present invention.

Referring to FIG. 6, an antenna apparatus 200 includes a board body 210, an antenna device 220, a board ground layer 230, an internal matching device 240, and a matching ground layer 250. The board body 210 includes a lower device region 215 and a lower ground region 217. The basic configuration of the antenna apparatus 200 of FIG. 6 is similar to that of the antenna apparatus 100 of FIGS. 1 and 2.

The internal matching device 240 includes a matching via 241, a matching line 243, and a branch line 245. More particularly, the branch line 245 diverges and extends from a certain point of the matching line 243, and is located in the lower device region 215 of the board body 210. As shown in FIG. 6, the branch line 245 may extend in a straight line with a first matching line of the matching line 243. The branch line 245 may also overlap a parallel component circuit of the antenna device 220. The branch line 245, together with the matching line 243, may be formed through a pattern of metal on a surface of the lower device region 215.

The antenna apparatus 200 having the internal matching device 240 may resonate in two frequency bands. Specifically, the antenna apparatus 200 allows for impedance matching in a first frequency band and a second frequency band, which is higher than the first frequency band. For example, the antenna apparatus 200 may resonate at about 1 GHz and about 2 GHz, respectively.

Figure 7:
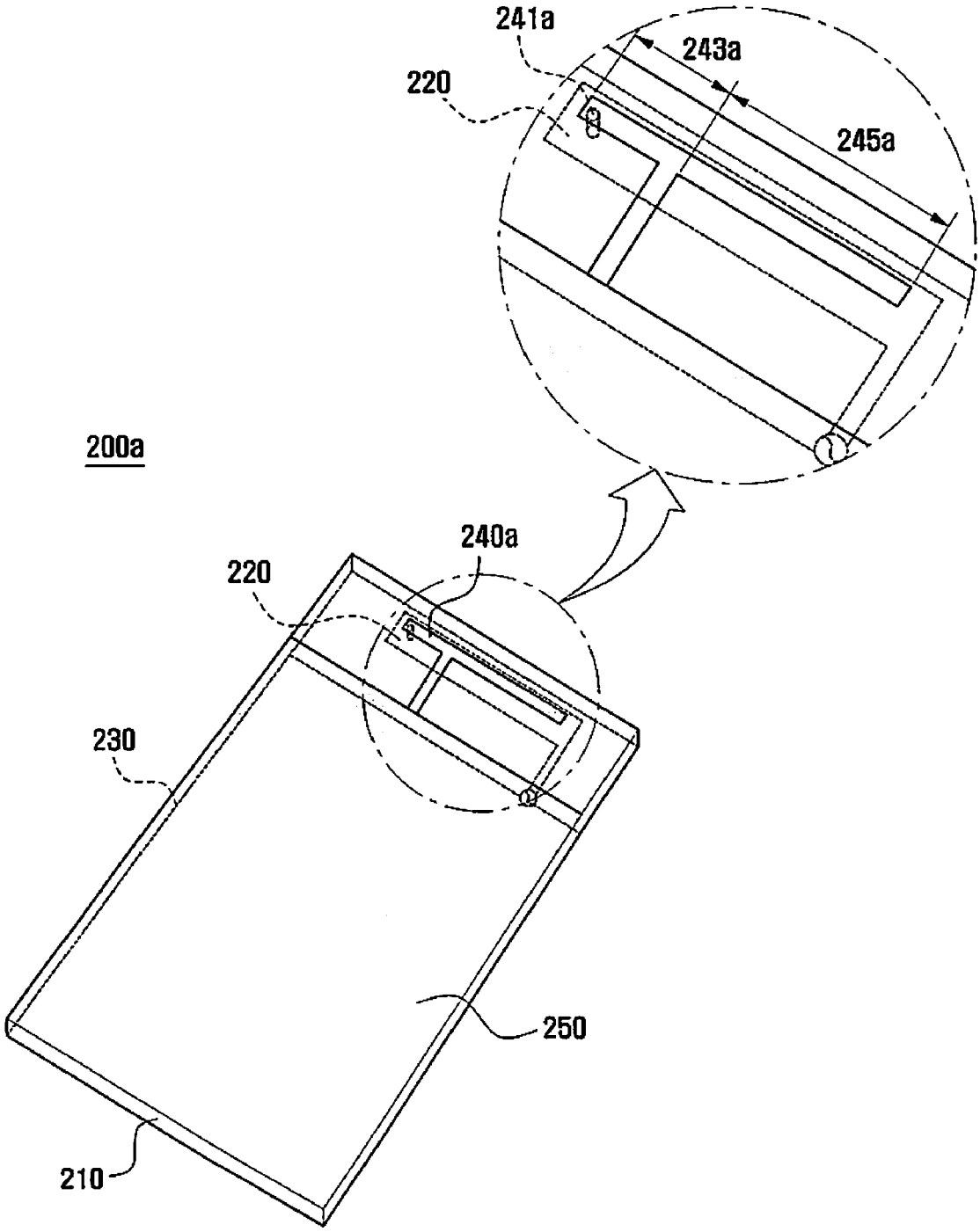
FIG. 7 is a diagram illustrating a perspective view of a rear side of a varied antenna apparatus, according to the second embodiment of the present invention.
Figure 8:
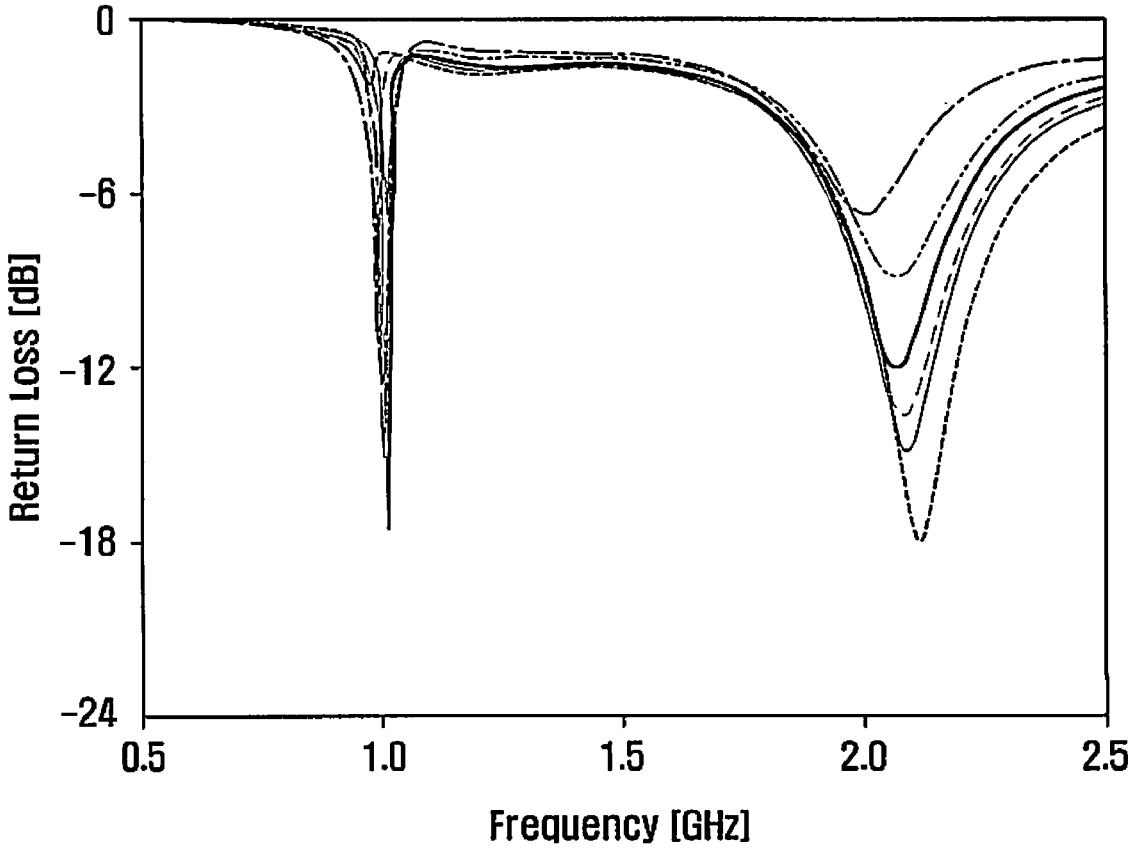
FIG. 8 is a graph illustrating impedance matching characteristics of a varied antenna apparatus, according to the second embodiment of the present invention.

FIG. 7 is a diagram illustrating a perspective view of a rear side of a varied antenna apparatus, according to the second embodiment of the present invention. FIG. 8 is a graph illustrating impedance matching characteristics of a varied antenna apparatus, according to the second embodiment of the present invention.

Referring to FIG. 7, a length of a matching line 243*a*, namely, the length of a path from a matching via 241*a* to the matching ground layer 250 may be varied. Regardless of a branch line 245*a*, the second frequency band may vary according to the length of the matching line 243*a*. Specifically, in an antenna apparatus 200*a* having an internal matching device 240*a*, the second frequency band will increase as the matching line 243*a* increases in length. FIG. 8 illustrates experimental results of this relationship.

Figure 9:
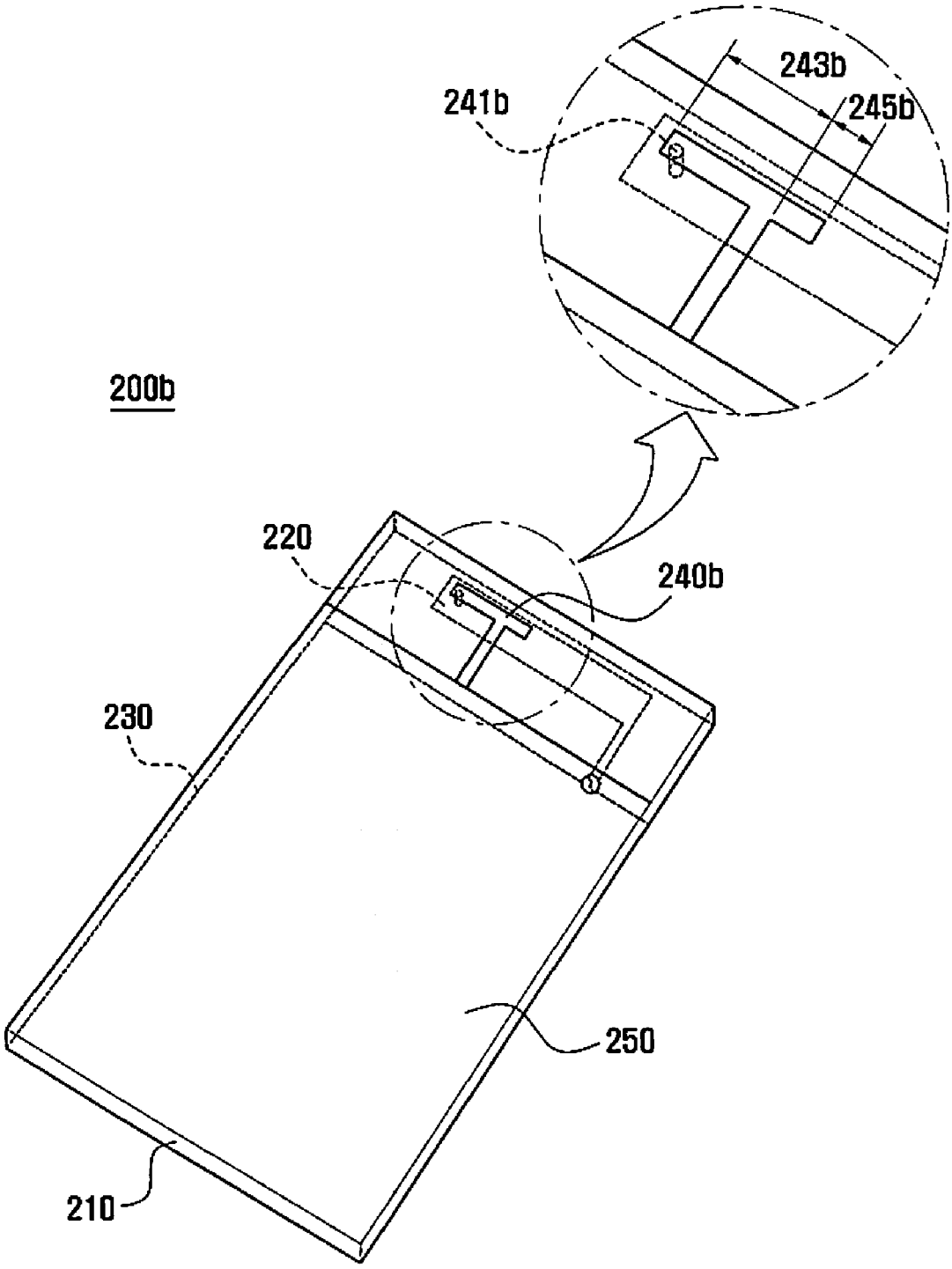
FIG. 9 is a diagram illustrating a perspective view of a rear side of another varied antenna apparatus, according to the second embodiment of the present invention.
Figure 10:
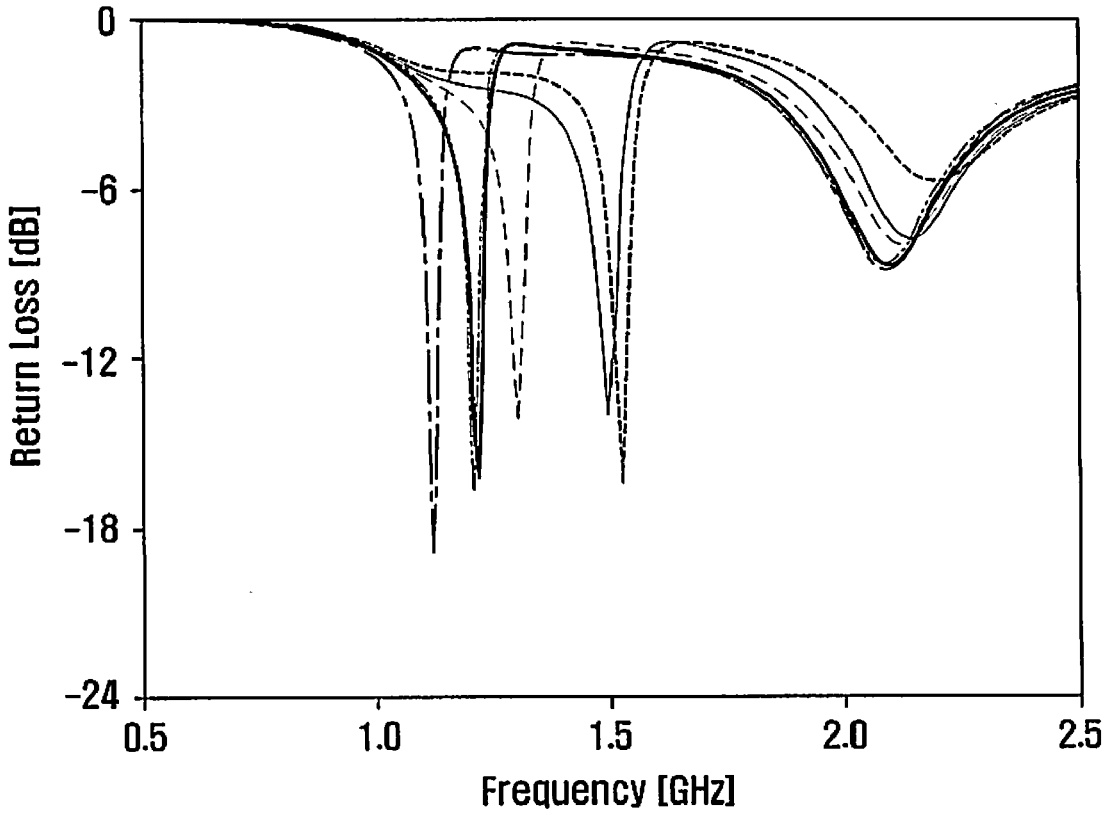
FIG. 10 is a graph illustrating impedance matching characteristics of another varied antenna apparatus, according to the second embodiment of the present invention.

FIG. 9 is a diagram illustrating a perspective view of a rear side of another varied antenna apparatus, according to the second embodiment of the present invention. FIG. 10 is a graph illustrating impedance matching characteristics of another varied antenna apparatus, according to the second embodiment of the present invention.

Referring to FIG. 9, a sum of a length of a matching line 243*b* and a length of a branch line 245*b* may be varied. Namely, a length of a parallel component circuit from a matching via 241*b* in an internal matching device 240*b* may be varied. The first frequency band may vary according to the sum of the length of the matching line 243*b* and the length of the branch line 245*b*. Specifically, in an antenna apparatus 200*b* having the internal matching device 240*b*, the first frequency band will increase as the sum of the aforesaid lengths decreases. FIG. 10 illustrates experimental results of this relationship.

According to this embodiment of the present invention, the antenna apparatus 200, 200*a* or 200*b* allows for resonance in several frequency bands by applying the branch line 245, 245*a* or 245*b* to the internal matching device 240, 240*a* or 240*b*. Additionally, by changing the length of the internal matching device 240, 240*a* or 240*b*, the antenna apparatus 200, 200*a* or 200*b* may resonate in varied frequency bands.

Although the above embodiments describe antenna devices in the form of an ILA, the present invention is not limited thereto. Alternatively, the antenna device of this invention may be formed as one of a particular type of transmission line, such as a meander type, a spiral type, a step type, a loop type, and so forth. Furthermore, the antenna device may be formed as any other type, such as Planar Inverted F Antenna (PIFA), monopole antenna, or dipole antenna. A related case is described in greater detail below with reference to FIG. 11.

Figure 11:
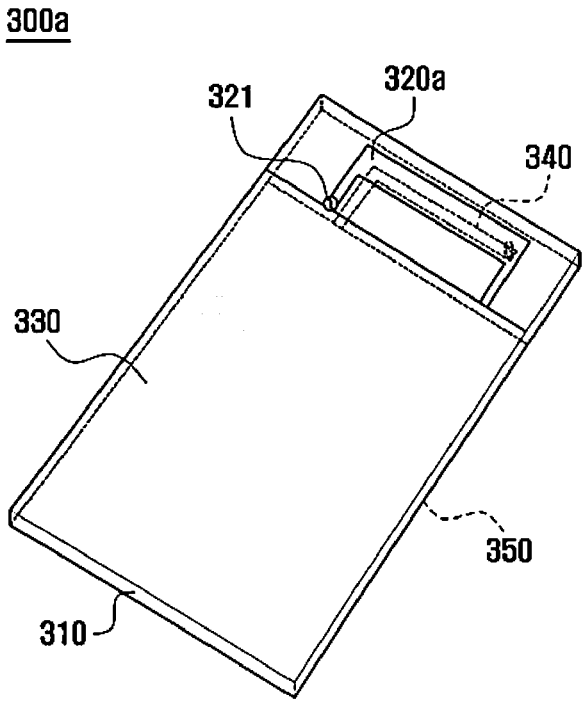
FIGS. 11(*a*) and (*b*) are a diagrams illustrating perspective views of a front side of an antenna apparatus, according to a third embodiment of the present invention.
Figure 11:
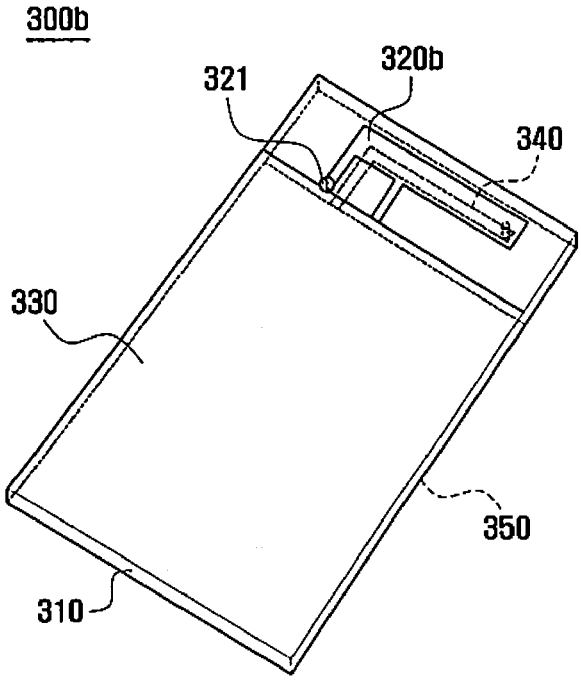

FIG. 11 is a diagram illustrating a perspective view of a front side of an antenna apparatus, according to a third embodiment of the present invention. The antenna apparatus of this embodiment is fabricated in accordance with PCB technology.

An antenna apparatus 300*a* or 300*b* of this embodiment includes a board body 310, an antenna device 320*a* or 320*b*, a board ground layer 330, an internal matching device 340, and a matching ground layer 350. The basic configuration of the antenna apparatus 300*a* or 300*b* in FIG. 11 is similar to those described above.

As shown in FIG. 11(*a*), the antenna device 320*a* is formed as a loop type antenna. Alternatively, as shown in FIG. 11(*b*), the antenna device 320*b* is formed as a PIFA type antenna. Here, the antenna device 320*a* or 320*b* has at one portion a feed point 321 near the board ground layer 330 and is connected at other portion to the board ground layer 330.

Although the above embodiments describe the internal matching device in the form of an ILA, the present invention is not limited thereto. Similarly, the internal matching device may be alternatively formed as one of a particular type of transmission line, such as a meander type, a spiral type, a step type, a loop type, and so forth. Furthermore, the internal matching device may be formed as any other type, such as Planar Inverted F Antenna (PIFA), monopole antenna, or dipole antenna. A related embodiment is described in greater detail below with reference to FIG. 12.

Figure 12:
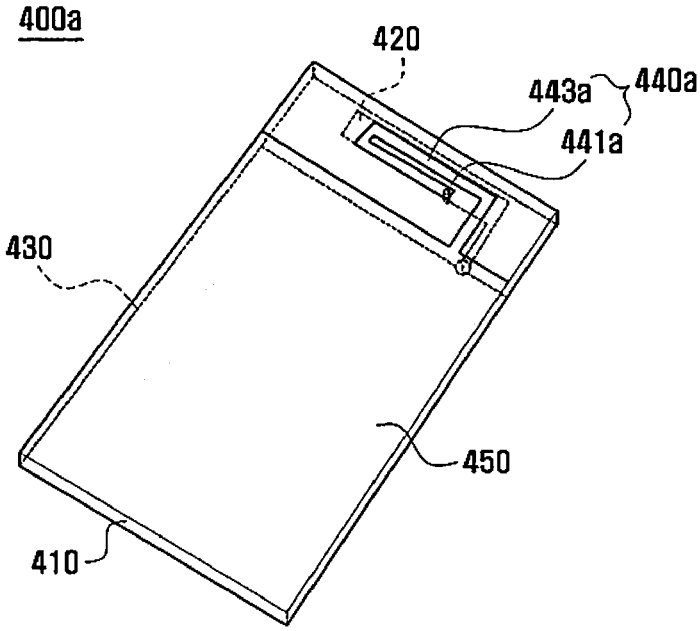
FIGS. 12(*a*) and (*b*) are a diagrams illustrating perspective views of a rear side of an antenna apparatus, according to a fourth embodiment of the present invention.
Figure 12:
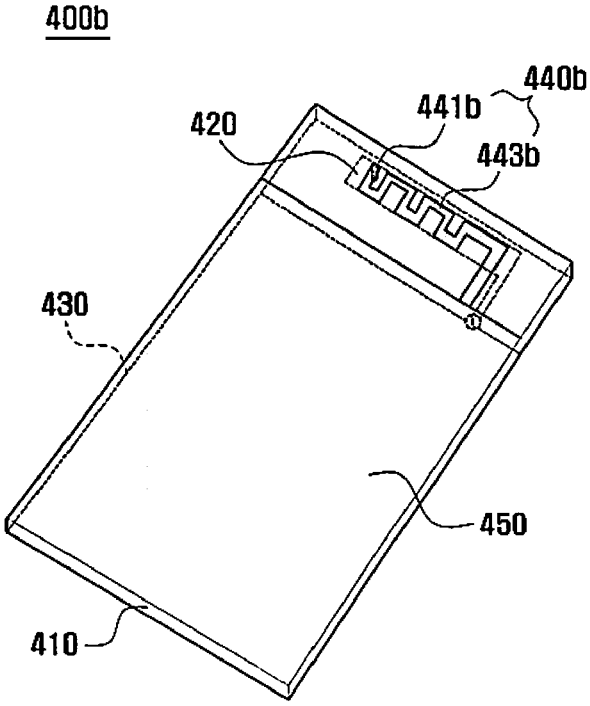

FIG. 12 is a diagram illustrating a perspective view of a rear side of an antenna apparatus, according to a fourth embodiment of the present invention. The antenna apparatus of this embodiment is fabricated in accordance with PCB technology.

An antenna apparatus 400*a* or 400*b* includes a board body 410, an antenna device 420, a board ground layer 430, an internal matching device 440*a* or 440*b*, and a matching ground layer 450. The basic configuration of the antenna apparatus 400*a* or 400*b* of FIG. 12 is similar to those described above.

As shown in FIG. 12(*a*), the internal matching device 440*a* may be formed as a loop type transmission line. Alternatively, as shown in FIG. 12(*b*), the internal matching device 440*b* may be formed as a meander type transmission line. A matching via 441*a* or 441*b* and a first matching line of a matching line 443*a* or 443*b* may overlap a parallel component circuit of the antenna device 420. Additionally, a second matching line of the matching line 443*a* or 443*b* may be connected to the matching ground layer 450.

According to the third and fourth embodiments of the present invention in FIGS. 11(*a*), 11(*b*), 12(*a*) and 12(*c*), the antenna apparatus 300*a*, 300*b*, 400*a* or 400*b* allows for resonance in various frequency bands depending on the form of at least one of the antenna device 320*a*, 320*b* or 420 and the internal matching device 340, 440*a* or 440*b*. Specifically, by altering the form of at least one of the antenna device and the internal matching device, the resonant frequency band of the antenna apparatus 300*a*, 300*b*, 400*a* or 400*b* may be varied.

Although the above embodiments describe an antenna device and an internal matching device that are patterned directly on the board body, the present invention is not limited thereto. Alternatively, at least one of the antenna device and the internal matching device may be fabricated on an element other than the board body, such as an external case of a communication terminal, a device carrier mounted on the board body, and so forth. A related embodiment is described in greater detail below with reference to FIG. 13.

Figure 13:
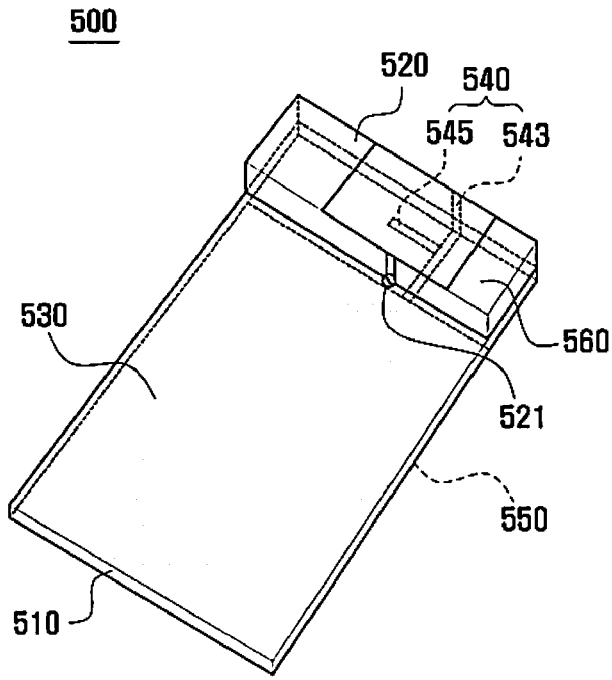
FIG. 13 is a diagram illustrating a perspective view of a front side of an antenna apparatus, according to a fifth embodiment of the present invention.

FIG. 13 is a diagram illustrating a perspective view of a front side of an antenna apparatus, according to a fifth embodiment of the present invention. The antenna apparatus of this embodiment is fabricated in accordance with PCB technology.

An antenna apparatus 500 includes a board body 510, an antenna device 520, a board ground layer 530, an internal matching device 540, and a matching ground layer 550. The basic configuration of the antenna apparatus 500 of FIG. 13 is similar to those described above.

The antenna apparatus 500 further includes a device carrier 560, which has a flat block-like structure with a certain thickness. Additionally, the device carrier 560 is predominantly formed of a dielectric material, which may have different dielectric constant than that of the board body 510. The device carrier 560 is mounted on an upper surface of the board body 510.

The antenna device 520 is formed on an upper surface of the device carrier 560 through a pattern of metal. Therefore, the antenna device 520 is separated from the board ground layer 530, creating a space therebetween. A feed point 521 is disposed at one portion of the antenna device 520 near the board ground layer 530. The internal matching device 540 extends from the antenna device 520 and is also formed on the lower surface of the board body 510. The internal matching device 540 may be connected to the antenna device 520 through a matching line 543 elongated along one lateral surface of the device carrier 560, instead of through the matching via.

The antenna apparatus 500 has a space between the antenna device 520 and the board ground layer 530 that is created by insertion of the device carrier 560. Alternatively, such a space may be created between the internal matching device 540 and the matching ground layer 550. By changing the thickness of the device carrier 560, operation efficiency characteristics of the antenna apparatus 500 may be improved.

Although the above embodiments describe an internal matching device and an antenna device that are disposed on different surfaces of the board body, the present invention is not limited thereto. Alternatively, the internal matching device and the antenna device may be formed together on the same surface of the board body. A related embodiment is described in greater detail below with reference to FIG. 14.

Figure 14:
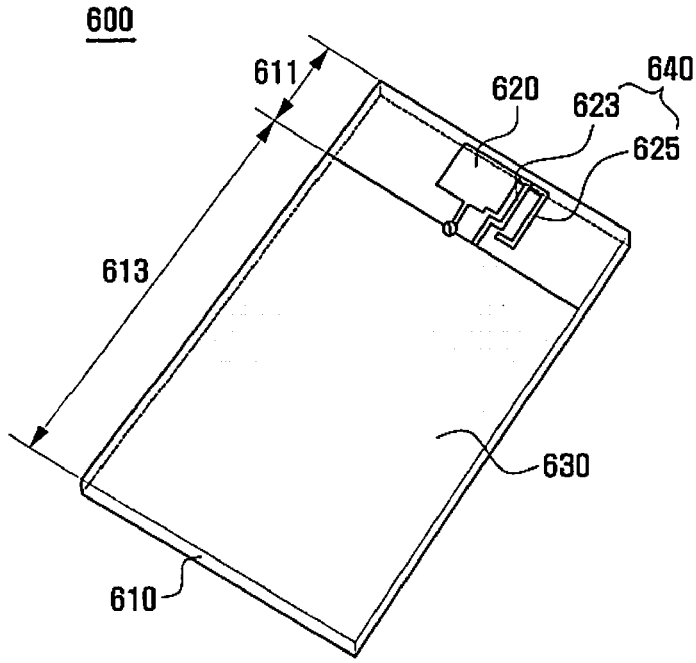
FIG. 14 is a diagram illustrating a perspective view of a front side of an antenna apparatus, according to a sixth embodiment of the present invention.

FIG. 14 is a diagram illustrating a perspective view of a front side of an antenna apparatus, according to a sixth embodiment of the present invention. The antenna apparatus of this embodiment is fabricated in accordance with PCB technology.

An antenna apparatus 600 includes a board body 610, an antenna device 620, a board ground layer 630, an internal matching device 640, and a matching ground layer 650. The basic configuration of the antenna apparatus 600 of FIG. 14 is similar to those described above.

The internal matching device 640, together with the antenna device 620, is formed in an upper device region 611 on an upper surface of the board body 610.

The internal matching device 640 extends from and is located near the antenna device 620. The internal matching device 640 is connected to the board ground layer 630 in an upper ground region 613.

Although the above embodiments describe the board body as a flat structure with four corners, the present invention is not limited thereto. Alternatively, the board body may have a corner-less form or a number of corners other than four. Specifically, the shape of the board body may be determined according to the shape of an internal space for receiving the antenna apparatus in a communication terminal.

According to the present invention, the antenna apparatus may allow for internal impedance matching by specially employing the internal matching device therein.

The internal matching device is formed as a transmission line, thus reducing a return loss during resonance and improving impedance matching characteristics of the antenna apparatus. Furthermore, the internal matching device, together with the antenna device, resonates in a specific frequency band. Operation efficiency characteristics of the antenna apparatus are also improved.

Additionally, by altering a configuration or a dimension of the internal matching device, a resonance in several or varied frequency bands may be possible.

Moreover, since impedance matching is allowed without any external matching circuit, the antenna apparatus does not require a space for an external matching circuit. It is therefore possible to realize a space-effective and size-reduced communication terminal.

While the invention has been shown and described with reference to certain embodiments thereof, it will be understood by those skilled in the art that various changes in form and detail may be made therein without departing from the spirit and scope of the invention as defined by the appended claims.

What is claimed is:

1. An antenna apparatus for internal impedance matching, the antenna apparatus comprising:

a board body formed of a dielectric material and having a flat structure;

an antenna device disposed on an upper surface of the board body, extending from a feed point, and having a first impedance; and an internal matching device disposed on a lower surface of the board body, connected to the antenna device, and having a second impedance used for matching the first impedance with a reference impedance, wherein the antenna device and the internal matching device resonate at the reference impedance in a specific frequency band when a voltage is supplied through the feed point.

2. The antenna apparatus of claim 1, wherein the internal matching device comprises at least one matching via configured to penetrate the board body to the antenna device, and a matching line that extends from the matching via on the lower surface of the board body.

3. The antenna apparatus of claim 2, wherein the matching line forms a single path.

4. The antenna apparatus of claim 2, wherein the internal matching device further comprises a branch line that diverges and extends from the matching line.

5. The antenna apparatus of claim 2, wherein the matching line has at least one bent portion and is formed as one of a meander type line, a spiral type line, a step type line, and a loop type line.

6. The antenna apparatus of claim 1, wherein the antenna device and the internal matching device are formed through patterns on the board body.

7. The antenna apparatus of claim 1, further comprising:

a device carrier mounted on the board body, wherein at least one of the antenna device and the internal matching device are formed through a pattern on the device carrier.

8. The antenna apparatus of claim 1, further comprising:

a matching ground layer disposed on the lower surface of the board body and connected to the internal matching device.

9. An antenna apparatus for internal impedance matching, the antenna apparatus comprising:

a board body formed of a dielectric material and having a flat structure;

an antenna device disposed on an upper surface of the board body, extending from a feed point, and having a first impedance;

an internal matching device disposed on the upper surface of the board body, connected to the antenna device, and having a second impedance used for matching the first impedance with a reference impedance; and, a board ground layer disposed on the upper surface of the board body and connected to the internal matching device, wherein the antenna device and the internal matching device resonate at the reference impedance in a specific frequency band when a voltage is supplied through the feed point.

10. The antenna apparatus of claim 9, wherein the internal matching device comprises a matching line that extends from the antenna device and forms a single path.

11. The antenna apparatus of claim 10, wherein the internal matching device further comprises a branch line that diverges and extends from the matching line.

12. The antenna apparatus of claim 10, wherein the matching line has at least one bent portion and is formed as one of a meander type line, a spiral type line, a step type line, and a loop type line.

13. The antenna apparatus of claim 9, wherein the antenna device and the internal matching device are formed through patterns on the board body.

14. The antenna apparatus of claim 9, further comprising:

a device carrier mounted on the board body, wherein at least one of the antenna device and the internal matching device are formed through a pattern on the device carrier.

* * * * *